US011694611B2

(12) United States Patent
Ha et al.

(10) Patent No.: US 11,694,611 B2
(45) Date of Patent: Jul. 4, 2023

(54) FOUR-WAY DUAL SCANNING ELECTRONIC DISPLAY BOARD CAPABLE OF SCAN CONTROL

(71) Applicant: KLD CO., LTD., Seongnam-si (KR)

(72) Inventors: Young-Jae Ha, Seoul (KR); Deok Sook Won, Anyang-si (KR); Jong Yuap Won, Gwangmyeong-si (KR); Seong Jun Ha, Anyang-si (KR)

(73) Assignee: KLD CO., LTD., Seongnam-si (KR)

( * ) Notice: Subject to any disclaimer, the term of this patent is extended or adjusted under 35 U.S.C. 154(b) by 0 days.

(21) Appl. No.: 17/777,667

(22) PCT Filed: Jan. 21, 2021

(86) PCT No.: PCT/KR2021/000840
§ 371 (c)(1),
(2) Date: May 18, 2022

(87) PCT Pub. No.: WO2021/150038
PCT Pub. Date: Jul. 29, 2021

(65) Prior Publication Data

US 2023/0045165 A1 Feb. 9, 2023

(30) Foreign Application Priority Data

Jan. 21, 2020 (KR) ..... 10-2020-0007703

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 3/2096* (2013.01); *G09G 2320/0233* (2013.01); *G09G 2320/0247* (2013.01); *G09G 2320/0276* (2013.01); *G09G 2340/0407* (2013.01)

(58) Field of Classification Search
CPC ..... G09G 3/32
See application file for complete search history.

(56) References Cited

U.S. PATENT DOCUMENTS

2022/0211259 A1* 7/2022 Kuramoto ..... A61B 1/000094

FOREIGN PATENT DOCUMENTS

| | | | |
|---|---|---|---|
| KR | 10-2000-0074497 | A | 12/2000 |
| KR | 10-2005-0096189 | A | 10/2005 |
| KR | 10-1176891 | B1 | 8/2012 |
| KR | 10-1737437 | B1 | 5/2017 |
| KR | 10-2017-0123392 | A | 11/2017 |

* cited by examiner

*Primary Examiner* — Gustavo Polo
(74) *Attorney, Agent, or Firm* — NKL Law; Jae Youn Kim

(57) ABSTRACT

A four-way dual scanning electronic display board capable of scan control, whereby, in order to provide drive control, an LED module arrangement method, and processing for each LED pixel dot (R, G, B), which are for easily enabling a high definition image, pixel display dots of an LED module are controlled by processing image display dots of the module by means of a four-way method by an automatic image switching device through the display control of SCU image switching, in order to display a high definition image through the four-way control of each image dot (R, G, B) pixel, and thus high resolution image quality may be enabled and displayed.

5 Claims, 19 Drawing Sheets

FOUR-WAY DUAL SCANNING ELECTRONIC DISPLAY BOARD CAPABLE OF SCAN CONTROL

TECHNICAL FIELD

The present invention relates to an LED electronic display board, and more particularly, to a four-way dual scanning electronic display board enabling scanning control, in which in order to provide an LED module arrangement method, and processing for each LED pixel dot (R, G, B), pixel display dots of an LED module are controlled by processing image display dots of the module in a four-way format by an automatic image switching device through the image display control for image switching by an SCU to display a high definition image through the four-way control for each image dot (R, G, B) pixel so that high-resolution image quality can be implemented and displayed.

BACKGROUND ART

A light-emitting diode (LED) refers to a semiconductor device that emits light, and is widely used in electronic display panels such as various kinds of electronic products and dashboards in various colors such as red, green, blue, and yellow.

Among them, an LED electronic display board includes a plurality of LEDs arranged in a matrix form to form pixels for displaying an image to enable the image to be displayed thereon. The LED electronic display board is installed in various forms at the outside or inside of a building so as to transmit advertisements or various kinds of information.

Generally, it is known that an electronic display board system displays information such as various characters or pictures by arranging an LED or a small fluorescent tube in a matrix form.

The electronic display board system receives an image signal from an AV apparatus such as a DVD, a VCR, broadcasting equipment or the like, and converts the image signal into a signal suitable for an electronic display board to allow an image to be displayed on the electronic display board.

In general, a module driver functions to display an image on the electronic display board with a one-to-one (1:1) configuration between a display image of an LED module and a dot (RGB). Although an image being transmitted is an ultra-high-definition image such as a UHD, an input image of the electronic display board is required to be driven to fit a screen of a display image of the electronic display board. Thus, it is required to reduce the resolution of the image of the electronic display board and perform various types of processes of changing the input image of the electronic display board to fit an input signal according to the size of the electronic display board.

Accordingly, high definition is also required in an image of the electronic display board such as the resolution of an image display board requiring high definition or the number of image processing bits requiring the resolution of a high pixel number, the processing speed of an image display frame, and the color sharpness in a high brightness image processing process. There is therefore a need for a control technique that can overcome the limitation of the transmission speed of the display image and the display size of the electronic display board in a display method of the electronic display board in order to display a high definition image of a UHD level or higher on the electronic display board, minimize a change in an image when displaying an LED dot (RGB) image on the electronic display board in order to implement an ultra-high-definition image, and enable to display a noise-free high definition image as it is even without any editing and correction process of the input image.

DISCLOSURE OF INVENTION

Technical Problem

The present invention has been made to solve the above-mentioned problems occurring in the prior art, and it is an object of the present invention to provide a four-way dual scanning electronic display board enabling scanning control, in which in order to provide an LED module arrangement method, and processing for each LED pixel dot (R, G, B), pixel display dots of an LED module are controlled by processing image display dots of the module in a four-way format by an automatic image switching device through the image display control for image switching by an SCU to display a high definition image through the four-way control for each image dot (R, G, B) pixel so that high-resolution image quality can be implemented and displayed.

Technical Solution

To accomplish the above object, the present invention provides a four-way dual scanning electronic display board enabling scanning control, including: an image signal source configured to provide an image signal to an LED electronic display board module; a main control unit (MCU) configured to switch, by dual scanning, an image in which an image data value with a gamma value determined on a histogram by an image processing DICT unit including a gray scale processor (GSP) has been gray-scaled by the GSP to equalize the image through gamma correction of the image and the histogram of the brightness of the image, so that image data with no noise can be transmitted even under the control of image transmission for high-speed processing; a server control unit (SCU) configured to control a signal designated by an integration time setting unit (ITS) to be switched to image data as image display data in response to the image data applied thereto after switching, by dual scanning, an image in which an image data value with the gamma value determined on the histogram by the image processing DICT unit of the MCU has been gray-scaled by the GSP and control the switched image data to be scanned onto pixel dots in a multi four-way format to display an image on an LED electronic display board module so as to allow a high-definition image to be displayed on the electronic display board; and the LED electronic display board module configured to form a screen in which unit pixels are formed in a matrix form by arranging any one of a red LED, a blue LED and a green LED in pairs in a diagonal direction and arranging the remaining two of the red LED, the blue LED and the green LED in two different diagonal directions adjacent to the diagonal direction, respectively, in such a manner that the unit pixels are arranged as unit display modules in which a plurality of LEDs are arranged for each of n×m dot (RGB) pixels in the form of a module array, and configured to allow the signal designated by the integration time setting unit (ITS) to be scanned onto pixel dots by the image switching unit in response to the image signal inputted through the image signal source so that image data is displayed thereon in a multi four-way format.

Advantageous Effects

As described above, the four-way dual scanning electronic display board enabling scanning control according to an embodiment of the present invention has an effect in that an image can be displayed by 16*16*4 dots (i.e., 1024 dots) pixels, but not 16*16 dots (i.e., 256 dots) per LED dot (RGB) module using a four-way format without an increase in the quantity of LED dots (RGB), and an image can be displayed in a four-way format even without an increase in the number of the LED module dots necessary for displaying an image on a general electronic display board to thereby create a 4-fold high resolution.

In addition, the four-way dual scanning electronic display board enabling scanning control according to an embodiment of the present invention has an effect in that it includes a module array multi scanning control function enabling to display a high-definition image through a four-way control for each of dot (RGB) pixels of the LED module to allow an image display dot of an LED module to be processed in a four-way format by an automatic image switching device using the control of an image display for image switching by the SCU to enable various image displays so that an image quality with a sharper and higher resolution can be implemented and displayed irrespective of the display size of the electronic display board through the control of the pixel display dot of the LED module.

In addition, the electronic display board for controlling four-way dual scanning in which a GSP is applied to a DICT according to an embodiment of the present invention has an effect in that a function of a general module driver, which displays an image on the electronic display board with a one-to-one (1:1) configuration between a display image of an LED module and a dot (RGB), is driven in the form of a dual scanning-based four-way image display to form a 4-fold image dot pixel arrangement to display an image in such a manner that a dot pixel is arbitrarily arranged in a multi form by a driving display dot (RGB) so that the image can be displayed on the electronic display board through the module driver in a dual/multi four-way format, and thus providing a maximum image display through a minimized dot pixel configuration.

Further, the four-way dual scanning electronic display board enabling scanning control according to an embodiment of the present invention has an effect in that each of unit pixels of a triangular shape, in which a plurality of red, green and blue LEDs are arranged adjacent to each other to implement a matrix form at a ratio of 1:1:1, is operated such that the unit pixels are sequentially displayed by scanning RGB of a basic pixel for each module dot (RGB) pixel so that each of the unit pixels is displayed at each resolution to thereby increase the entire resolution by 4-fold in the vertical and horizontal directions, and reduce the number of the LEDs necessary for driving.

Besides, the four-way dual scanning electronic display board enabling scanning control according to an embodiment of the present invention has an effect in that it provides an electronic display board control technology which can display a high-definition image using a four-way control for each image dot (RGB) pixel by enabling to apply a module array format of the electronic display board to a general LED module by means of the display control of the electronic display board, which can implement an image that is 4-fold sharper and brighter than that in the case of driving a general electronic display board through the driving control, the LED module arrangement, and the LED dot (RGB) pixel-dependent process method to easily implement a high-definition image.

BEST MODE FOR CARRYING OUT THE INVENTION

Hereinafter, preferred embodiments of according to the present invention will be described in detail with reference to the accompanying drawings in order for a person of ordinary skill in the art to sufficiently understand and carry out the present invention. In the following description of the present invention, a detailed description of related known functions and configurations incorporated herein will be omitted, if necessary, when it may rather make the subject matter of the present invention unclear.

The present invention provides an LED module control technology which can control an image display through the driving of an image switching unit of an SCU without an increase in the quantity of LED dots (RGB) instead of forming 256 dots to achieve high-definition display of the electronic display board to allow an image display dot of an LED module to be processed by automatic image switching to display an image with 1,024 dot pixels in a four-way format so that a high-resolution image can be displayed.

Figure 1:
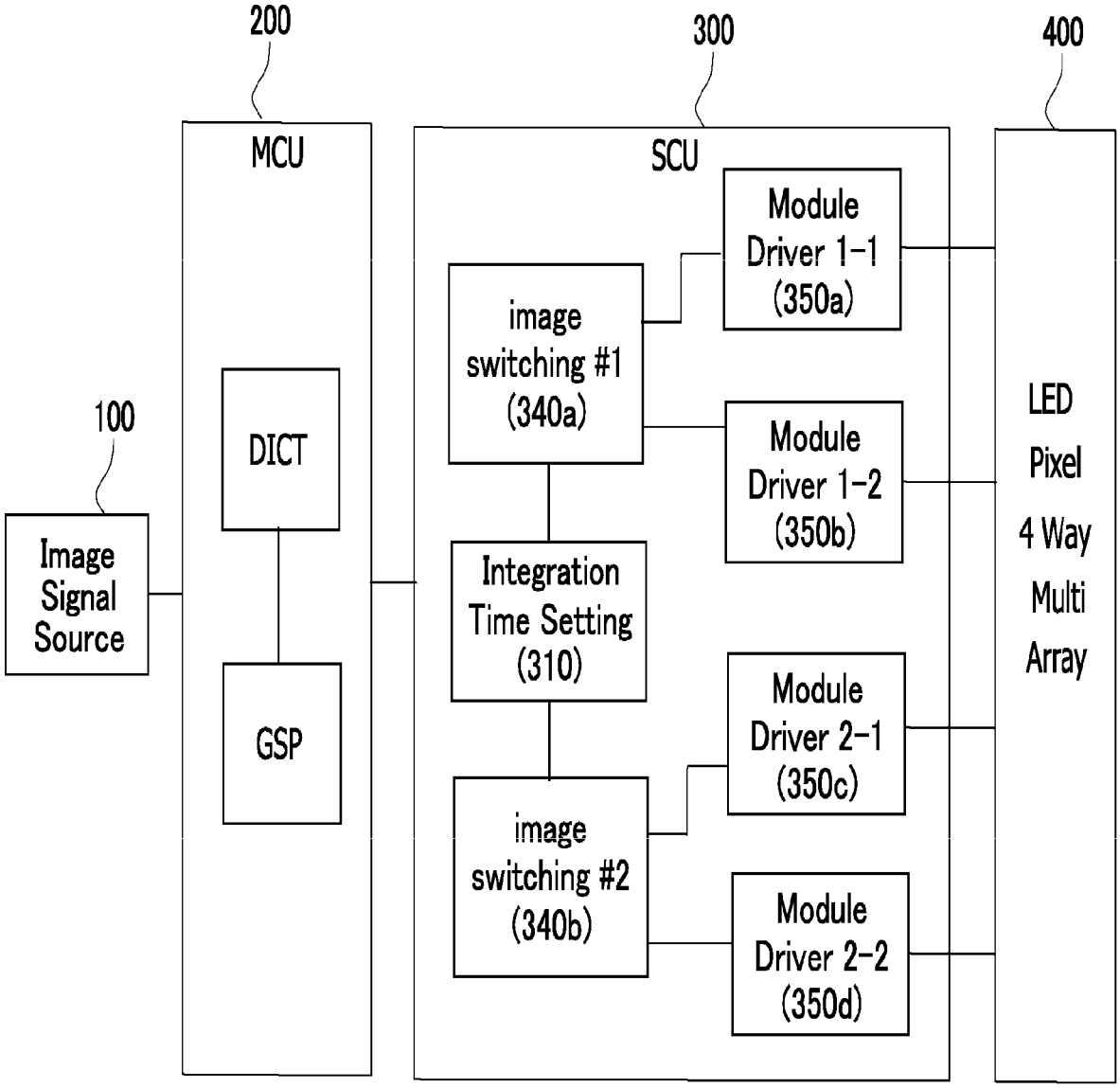
FIG. 1 is a block diagram showing a detailed configuration of a four-way dual scanning electronic display board enabling scanning control according to the present invention.

FIG. 1 is a block diagram showing a detailed configuration of a four-way dual scanning electronic display board enabling scanning control according to the present invention. Referring to FIG. 1, the four-way dual scanning electronic display board enabling scanning control includes an image signal source 100, an MCU 200, an SCU 300, and an electronic display board module 400.

The image signal source 100 provides an image signal to the LED electronic display board module 400. The LED electronic display board module 400 is provided in the form of a dot (RGB) pixel and receives the image signal from the image signal source 100 to display an image in such a manner that a dot pixel is arranged in a multi form by a driving display dot (RGB). The main control unit (MCU) 200 switches, by dual scanning, an image in which an image data value with a gamma value determined on a histogram by an image processing DICT unit 220 including a gray scale processor (GSP) 230 has been gray-scaled by the GSP 230 to equalize the image through gamma correction of the image and the histogram of the brightness of the image, so that image data with no noise can be transmitted even under the control of image transmission for high-speed processing and thus the image can be more stably displayed on the electronic display board even in the display of a high-definition image of the UHD level.

The MCU 200 includes a DICT control and a GSP function. The MCU 200 processes a DICT image for four-way high-resolution transmission of the image data so that the image can be displayed on the electronic display board without any noises by controlling phenomena such as interruption of the image and distortion of the image quality occurring when transmitting a high-definition image signal.

The MCU 200 enables a high-definition display even without any change in the data transmission speed or the number of image frames even in a high-definition driving state of the electronic display board through the implementation of the DICT and GSP functions for displaying the high-definition image with more sharpness under an environmental display change. In addition, the MCU 200 enables to easily display each of red, green and blue colors at 8 bits to 12 bits even in a general image in order to display RGB data even in an ultra-high-definition image of the UHD level according to 8 bits (256) to 10 bits (1024), and provides the GSP function so that calibration of the image display can be performed even in the maintenance process after installation.

The server control unit (SCU) 300 controls a signal designated by an integration time setting unit (ITS) 320 to be switched to image data as image display data by an image switching device 340 in response to the image data applied thereto after switching, by dual scanning, an image in which an image data value with the gamma value determined on the histogram by the DICT unit 220 of the MCU 200 has been gray-scaled by the GSP 230 and controls the switched image data to be scanned onto pixel dots in a multi four-way format through the driving of a module driver 350 to display an image on an LED electronic display board module 400 so as to allow a high-definition image to be displayed on the electronic display board.

In other words, in the control of the image display of an electronic display board that is generally driven, a simple distribution transmission function is adopted in which the image data from the MCU 200 is transmitted to an LED electronic display board module 400 to control the image data to enable to display an image. However, the electronic display board according to the present invention enables the SCU 300 to improve the quality of the display image to provide a high quality image through a reduction in flicker noise by a dot output value and a gray scale control value of an LED module of an image output section in response to the switched image data applied thereto from the GSP 230 so as to enhance the uniformity of White Balance, color, and brightness of an image which is displayed based on a dot output value and a gray scale pixel value of the LED module of the image output section.

The LED electronic display board module (400) is configured to form a screen by arranging, in a matrix form, a unit display module in which a plurality of LEDs are arranged for each of n×m dot (RGB) pixels in the form of a module array, and to allow the signal designated by the integration time setting unit (ITS) 320 to be scanned onto pixel dots by the image switching unit 340 in response to an image signal inputted through the image signal source so that image data is displayed thereon in a multi 4-way format.

Figure 2:
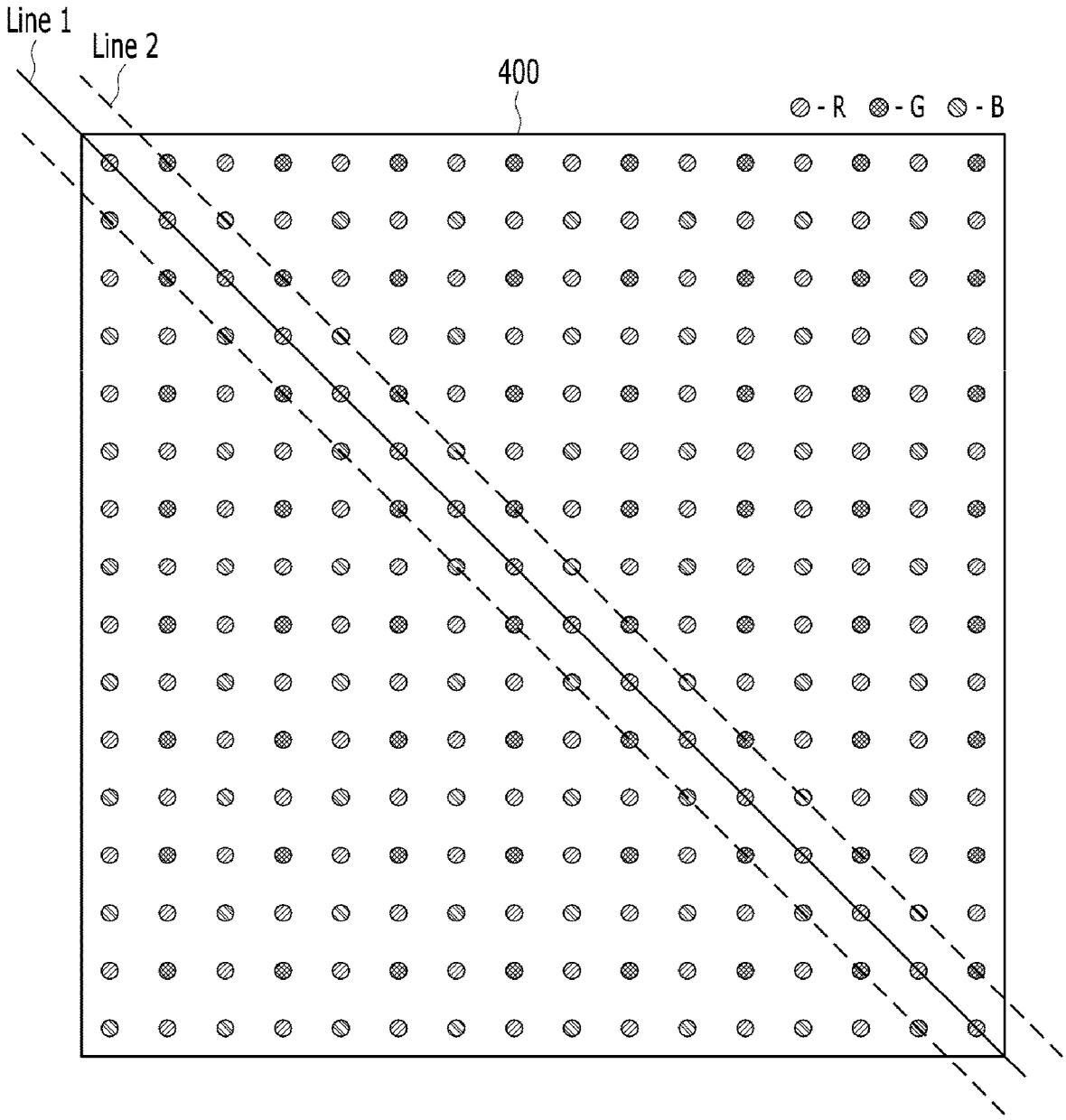
FIG. 2 is a schematic diagram showing a configuration of an LED module of a four-way dual scanning electronic display board enabling scanning control according to the present invention.

More specifically, as shown in FIG. 2, the LED module of the four-way dual scanning electronic display board enabling canning control is formed such that unit pixels are formed in a matrix form by arranging any one of a red LED, a blue LED and a green LED in pairs in a diagonal direction (Line 1) and arranging the remaining two of the red LED, the blue LED and the green LED in two different diagonal directions adjacent to the diagonal direction, respectively (Line 2).

Figure 12:
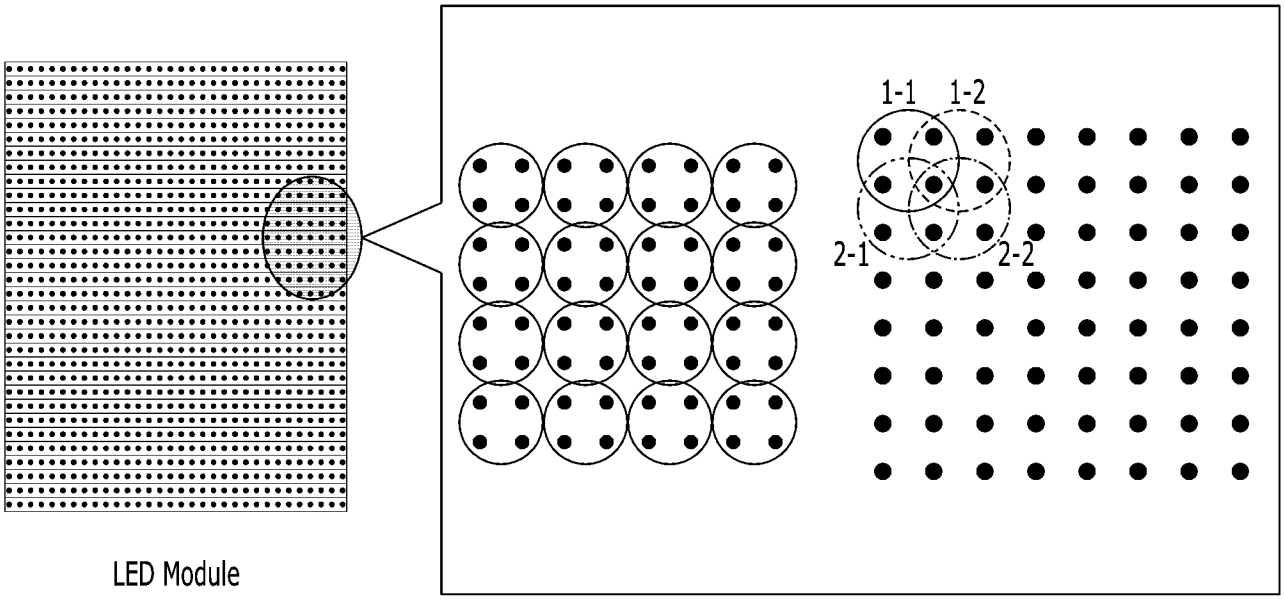
FIG. 12 is a schematic diagram showing a four-way dual scanning electronic display board enabling scanning control according to the present invention.

Thus, as shown in FIG. 12, four adjacent LEDs are provided as one unit pixel (1-1, 1-2, 2-1, 2-2) to form an LED display module.

Figure 3:
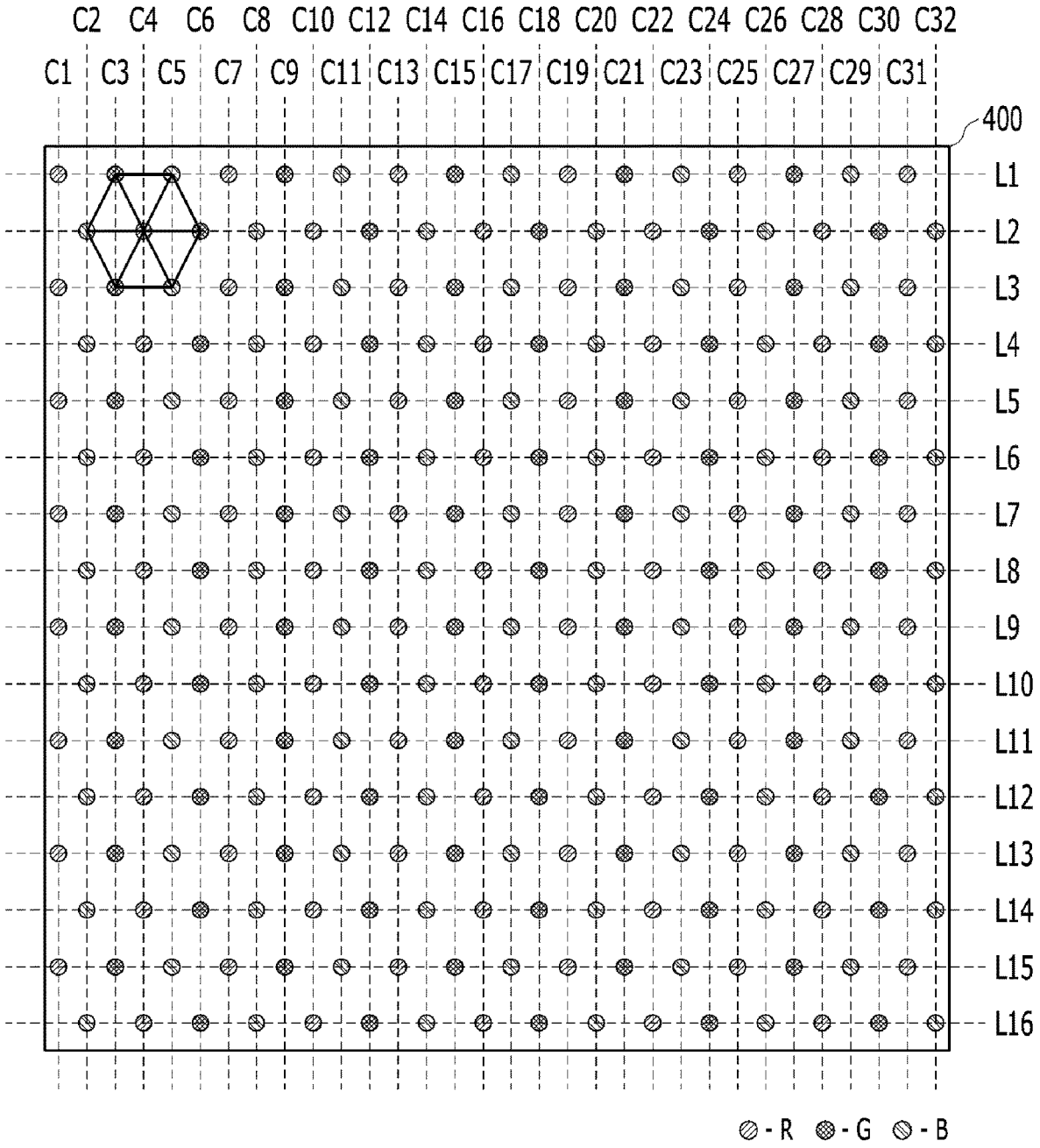
FIG. 3 is a schematic diagram showing a configuration of an LED module of a four-way dual scanning electronic display board enabling scanning control according to another embodiment of the present invention.

In addition, in another embodiment of the present invention, as shown in FIG. 3, the LED module of the four-way dual scanning electronic display board enabling canning control repeatedly arranges red, green and blue LEDs in odd-numbered columns of lines C1, C3, C5, C7 . . . , and repeatedly arranges blue and red and green LEDs in even-numbered columns of lines C2, C4, C6, C8 . . . to be positioned diagonally from the red, green and blue LEDs repeatedly arranged in the odd-numbered columns for one pixel so that a plurality of RGB LEDs for image representation are arranged in a matrix form at a ratio of 1:1:1 in such a manner that red, green and blue LEDs are repeatedly arranged in a triangular shape so as to be adjacent to each other.

Figure 18:
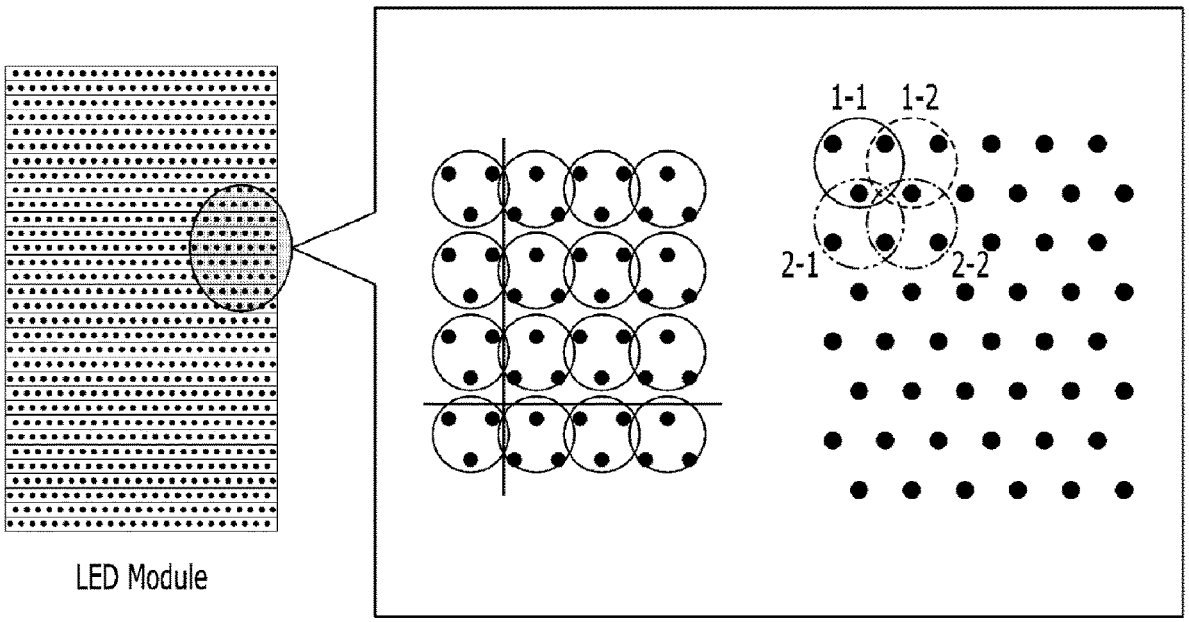
FIG. 18 is a schematic diagram showing a four-way dual scanning electronic display board enabling scanning control according to another embodiment of the present invention.
Figure 19:
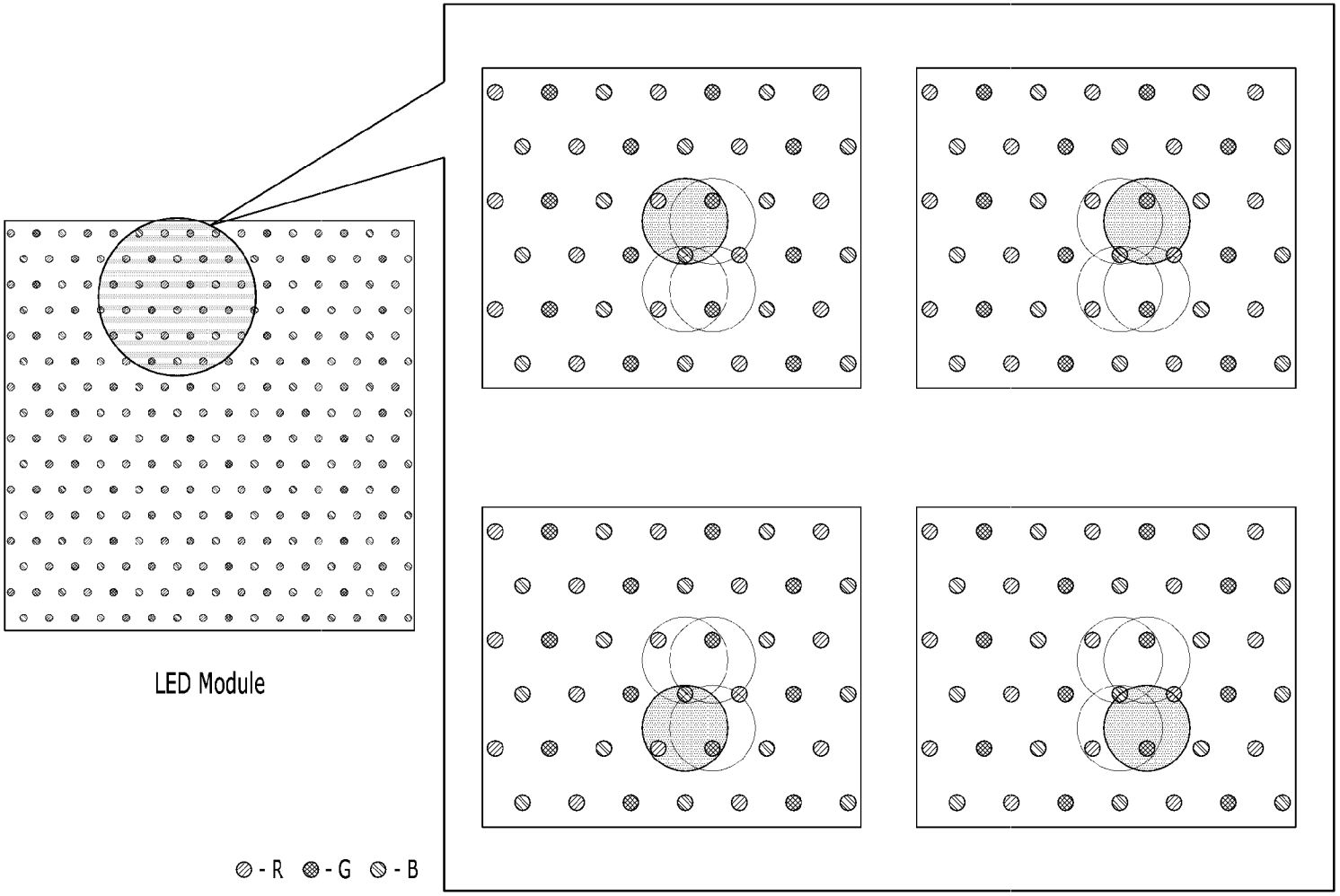
FIG. 19 is a schematic diagram showing a scan state of a four-way dual scanning electronic display board enabling scanning control according to another embodiment of the present invention.

Thus, as shown in FIG. 18, three adjacent LEDs are provided as one unit pixel (1-1, 1-2, 2-1, 2-2) to form an LED display module More specifically, the LED module repeatedly arranges red (R) and green (G) and blue (B) LEDs in odd-numbered columns (C1, C3, C7, C9, C13, C17, . . . ) of lines 1, 3, 5 and 7 (L1, L3, L5 and L7) and repeatedly arranges blue (B) and red (R) and green (G) LEDs in the odd-numbered columns (C1, C3, C7, C11, C15, C17, . . . ) of lines 2, 4, 6 and 8 (L2, L4, L6 and L8) so as to be positioned diagonally from the red, green and blue LEDs repeatedly arranged in the odd-numbered columns (C1, C3, C7, C9, C13, C17, . . . ) of lines 1, 3, 5 and 7 (L1, L3, L5 and L7) for one pixel so that red (R), green (G) and blue (B) LEDs are repeatedly arranged in a triangular shape so as to be adjacent to each other.

In addition, as shown in FIG. 3, light emitting diodes with red (R), green (G) and blue (B) colors are repeatedly arranged in the odd-numbered columns (C1, C3, C5, C7, C9, C11, C13, C15, C17, . . . ) of lines 1, 3, 5 and 7 (L1, L3, L5 and L7).

Subsequently, the LED module repeatedly arranges blue (B) and red (R) and green (G) LEDs in the even-numbered columns (C2, C4, C6, C8, C10, C12, C14, C16, C18, . . . )

of lines 2, 4, 6 and 8 (L2, L4, L6 and L8) so as to be positioned diagonally from the red, green and blue LEDs.

Accordingly, red (R) and green (G) LEDs arranged in the first and third columns (C1, C3) of the first line (L1) form one unit pixel of a triangular shape together with a blue (B) LED arranged in the second column (C2) of the second line (L2), and such a triangular shaped unit pixels are repeatedly formed continuously.

For example, the blue (B) LED arranged in the second column (C2) of the second line (L2) forms a unit pixel of a triangular shape together with the red (R) and green (G) LEDs arranged in the first and third columns (C1, C3) of the first line (L1), and forms a unit pixel of a triangular shape together with red (R) and green (G) LEDs arranged in the first and third columns (C1, C3) of the third line (L3).

Further, the blue (B) LED arranged in the second column (C2) of the second line (L2) is arranged adjacent to the red (R) LED arranged in the fourth column (C4) of the second line (L2) and the green (G) LED arranged in the third column (C3) of the third line (L3) to form one triangular unit pixel.

As constructed above, when arranged at a ratio of 1:1:1 within one pixel, the red (R), green (G) and blue (B) LEDs are repeatedly arranged to form a unit pixel of a triangular shape so that sharpness can be provided in response to the driving of the RGB LEDs of the LED module of the electronic display board.

As constructed above, the LED electronic display board module 400 of the present invention forms a screen by arranging, in a matrix form, a unit display module in which a plurality of LEDs are arranged for each of N×M pixels in the form of a module array, and displays image data generated by correcting brightness for image data inputted through real-time synthesis between an image data stream and a brightness correction data applied in consideration of the luminance of the pixel of the electronic display board or the brightness value in response to the image signal inputted through the image signal source.

Figure 4:
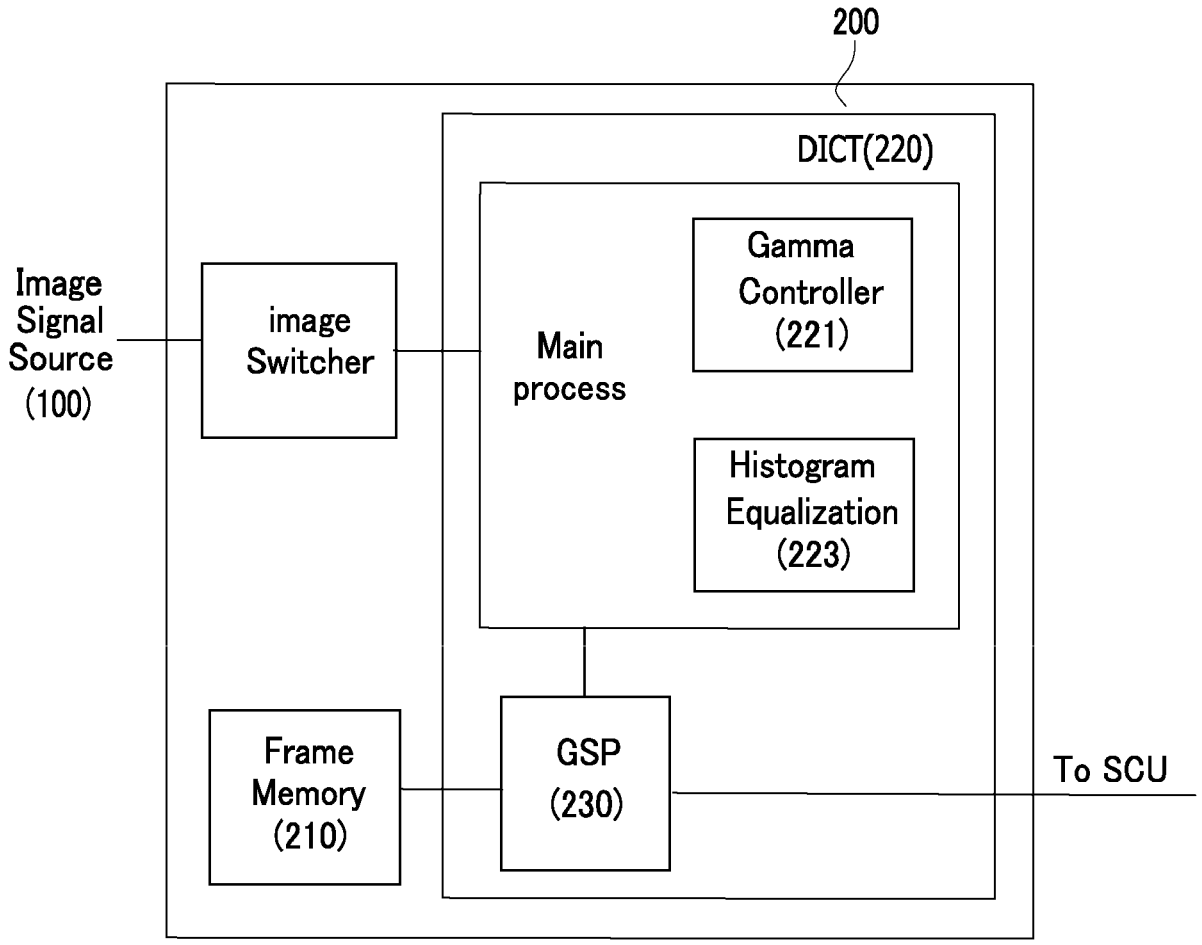
FIG. 4 is a block diagram showing an inner configuration of an MCU of FIG. 1.
Figure 5:
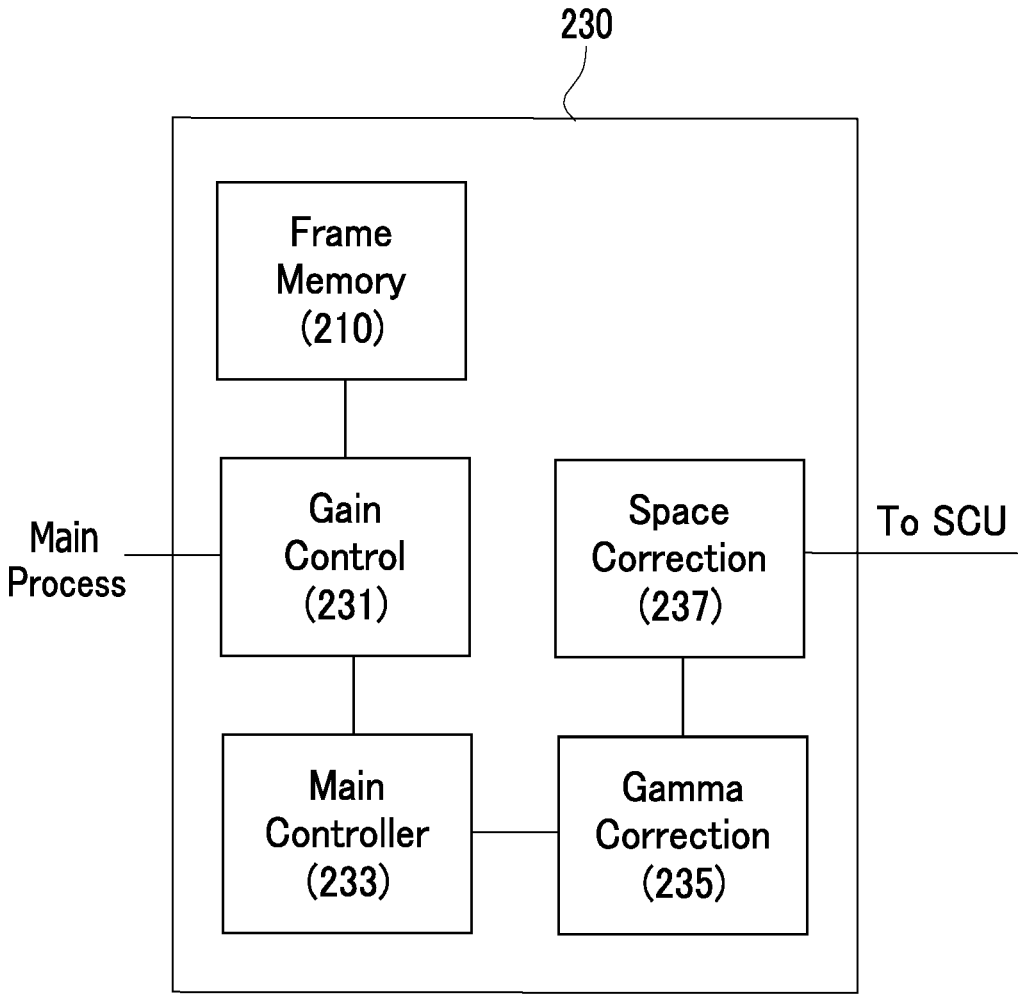
FIG. 5 is a block diagram showing an inner configuration of a GSP within an MCU of FIG. 1.
Figure 6:
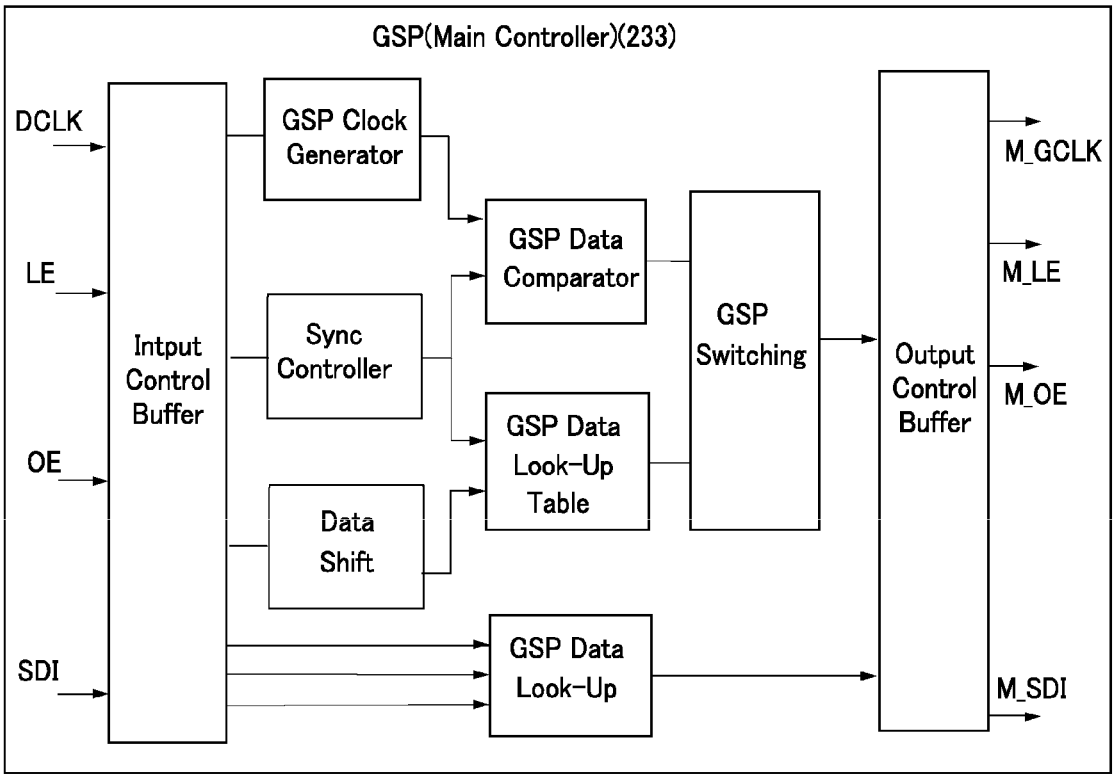
FIG. 6 is a block diagram showing an inner configuration of a main controller of a GSP within the MCU.

FIG. 4 is a block diagram showing an inner configuration of an MCU of FIG. 1, FIG. 5 is a block diagram showing an inner configuration of a GSP within an MCU of FIG. 1, and FIG. 6 is a block diagram showing an inner configuration of a main controller of a GSP within the MCU. An operation of the MCU 200 will be described hereinafter with reference to FIGS. 1 to 6. The MCU 200 of the present invention is operated to be divided into the DICT 220 including a histogram equalizer 233 and the GSP 230. The main control unit (MCU) 200 switches, by dual scanning, an image in which an image data value with a gamma value determined on a histogram by a gamma controller 221 of an image processing DICT unit 220 including a gray scale processor (GSP) 230 has been gray-scaled by the GSP 230 to equalize the image through gamma correction of the image and the histogram of the brightness of the image, so that image data with no noise can be transmitted even under the control of image transmission for high-speed processing and thus image can be more stably displayed on the electronic display board even in the display of a high-definition image of the UHD level.

The histogram equalizer 223 equalizes the image signal generated from the gamma controller 221 through synchronization and applied thereto by expressing, as a function, a ratio of the image signal to the number of pixels and uniformizing contrast value distribution to divide contrast values concentrated on one spot.

In addition, the gray scale processor (GSP) 230 includes a gain controller 231, a main controller 233, a gamma corrector 235, and a space corrector 237. The gray scale processor (GSP) 230 fetches and transmits relevant image data that is stored in a frame memory 210 when image information from the image signal source 100 is reproduced through an image switcher. In order to transmit the relevant image data, a gain controller 231 controls a frame frequency of an output image by converting a low-level gray scale into a high-level gray scale through the adjustment of a refresh rate with respect to the kind of information on an input image stored in the frame memory 210 in a frame unit.

The main controller 233 reads RGB (Red, Green and Blue) image data outputted from the frame memory having data stored therein in response to a memory read signal controlled by signals CLK and LATCH, and controls the data read from the memory to be stored in a shift register of an LED constant current drive IC and controls the image data to be outputted to LEDs by color depending on each data when an output control signal OE (Out Enable) is asserted.

More specifically, the main controller 233 generates signals SHIFT CLOCK and LATCH necessary for displaying a high quality image based on a dot output value and a gray scale control value of an LED module of an image output section, and increases a refresh rate without any direct increase in a clock rate of Read/Write Timing of the frame memory so that Timing Control is controlled by the OE (Out Enable) signal of the constant current drive IC to output an image without any influence of Read/Write Timing of the frame memory. The main controller 233 reads RGB (Red, Green and Blue) image data outputted from the frame memory having data stored therein in response to a memory read signal controlled by signals CLK and LATCH. The data read from the memory is stored in a shift register of an LED constant current drive IC and the image data is outputted to LEDs by color depending on each data when an output control signal OE (Out Enable) is asserted.

The gamma corrector 235 controls brightness correction so as to enhance the uniformity of White Balance, color, and brightness of an image which is displayed based on a dot output value and a gray scale pixel value of the LED module. In other words, the gamma corrector 235 converts the image into a gray scale bit source image signal of a target value with respect to the controlled refresh rate according to a gray scale adjusted through the gain controller 231 and generates a gray scale clock suitable for a gray scale bit conversion logic and a control and synchronization signal of a horizontal synchronization signal and a data clock for transmission to control brightness correction so as to enhance the uniformity of White Balance, color, and brightness of an image which is displayed based on a dot output value and a gray scale pixel value of the LED module.

The space corrector 237 generate the gray scale clock suitable for a gray scale bit conversion logic and the control and synchronization signal of the horizontal synchronization signal and the data clock for transmission.

Figure 7:
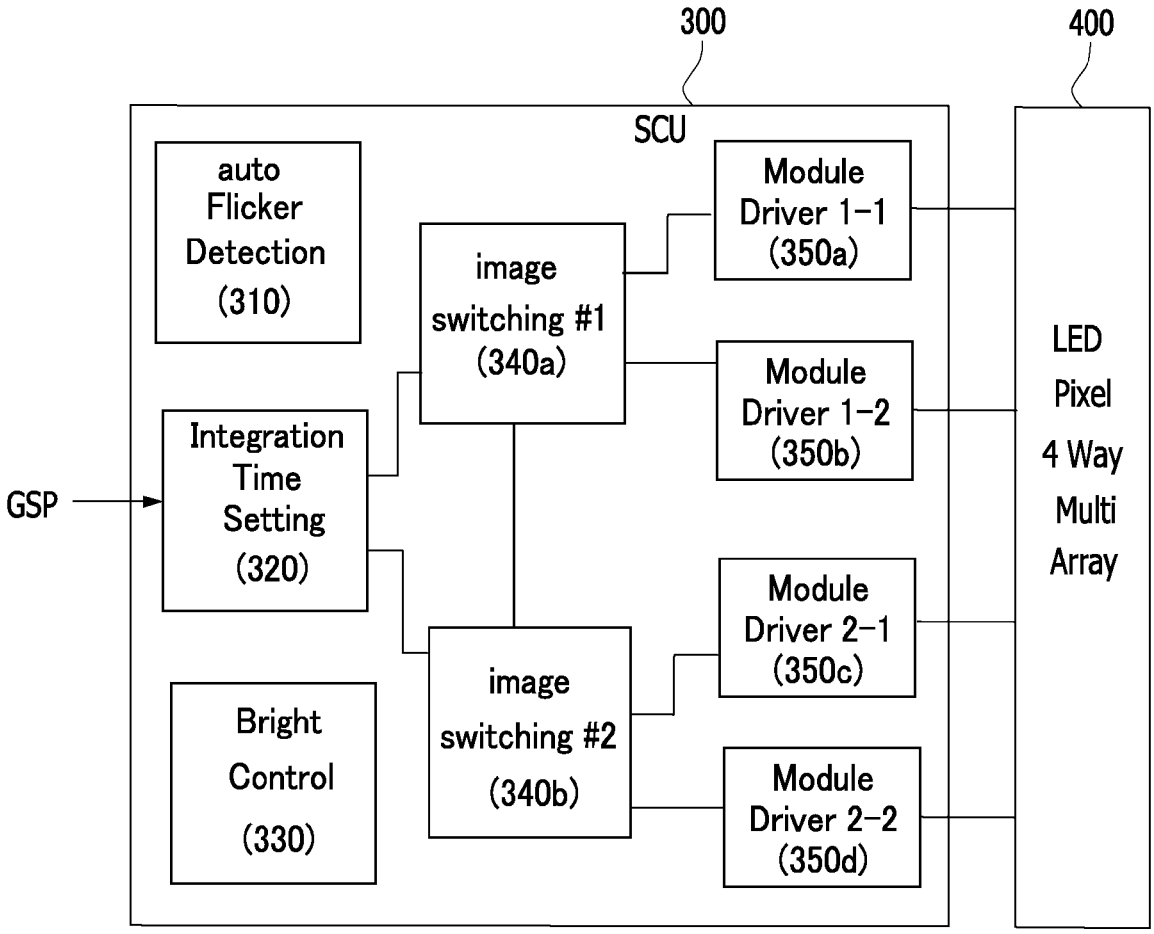
FIG. 7 is a block diagram showing an inner configuration of an SCU of FIG. 1.
Figure 8:
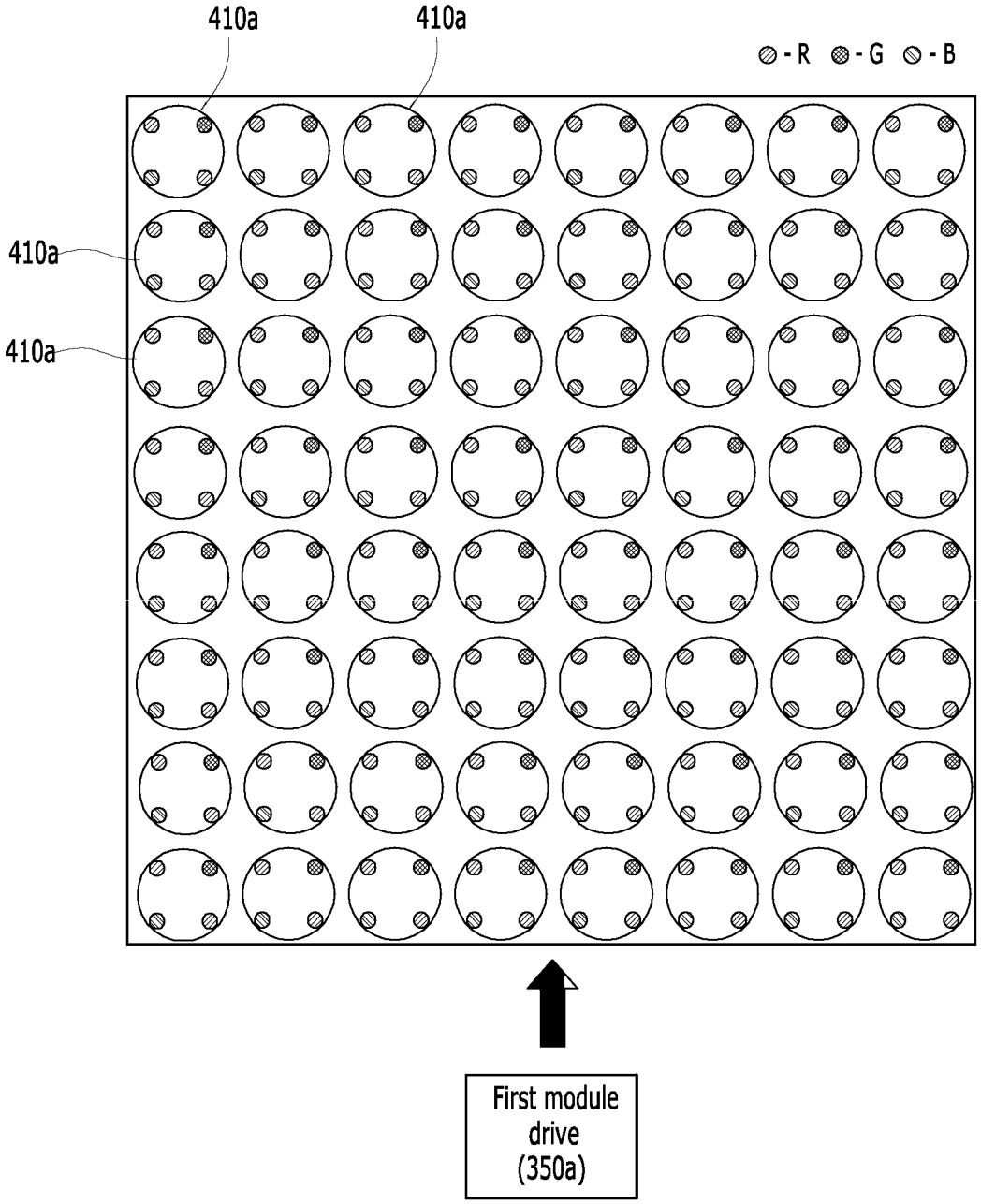
FIGS. 8 to 11 are state diagrams showing the pixel-dependent driving of an LED module of a four-way dual scanning electronic display board enabling scanning control according to the present invention.
Figure 9:
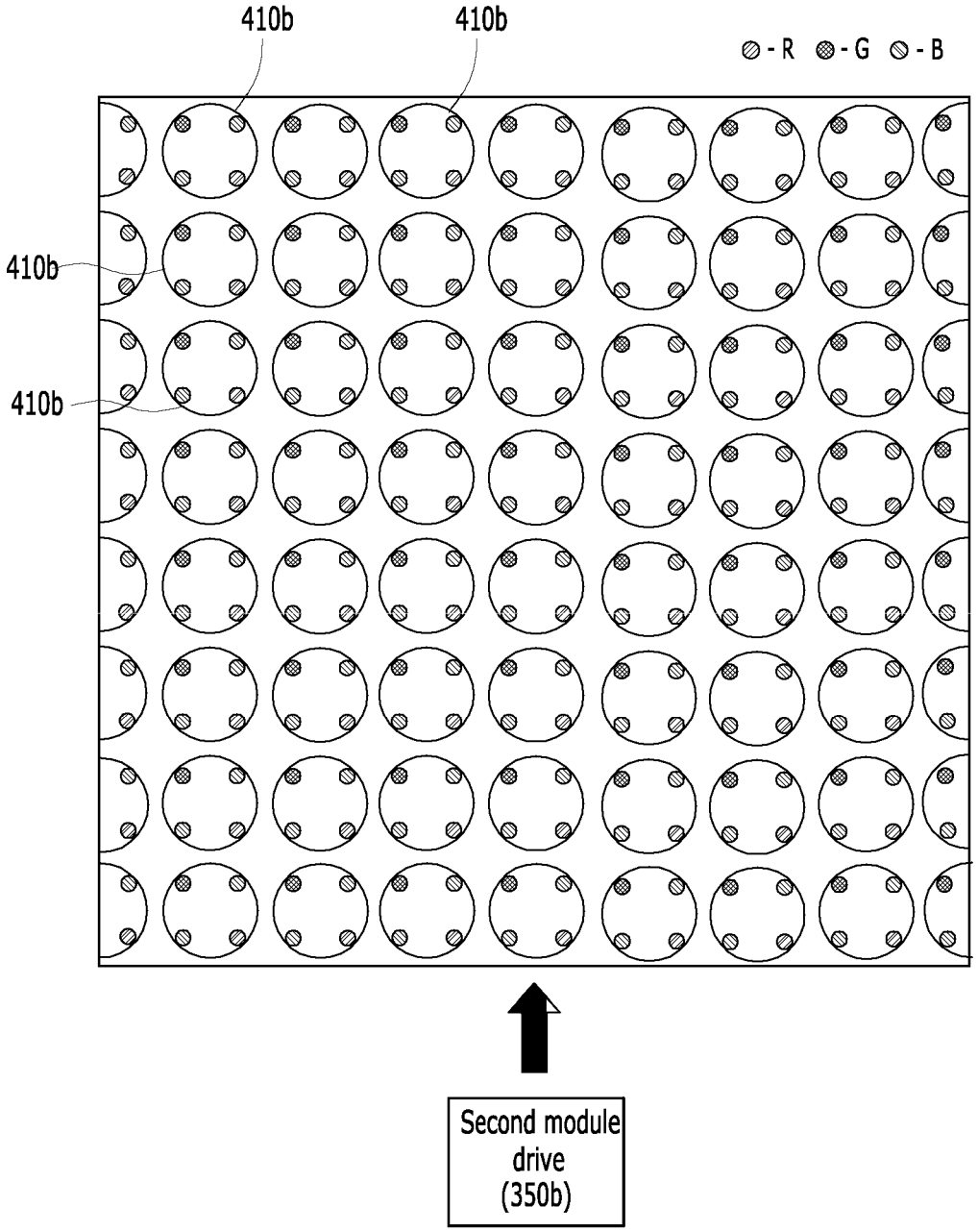
Figure 10:
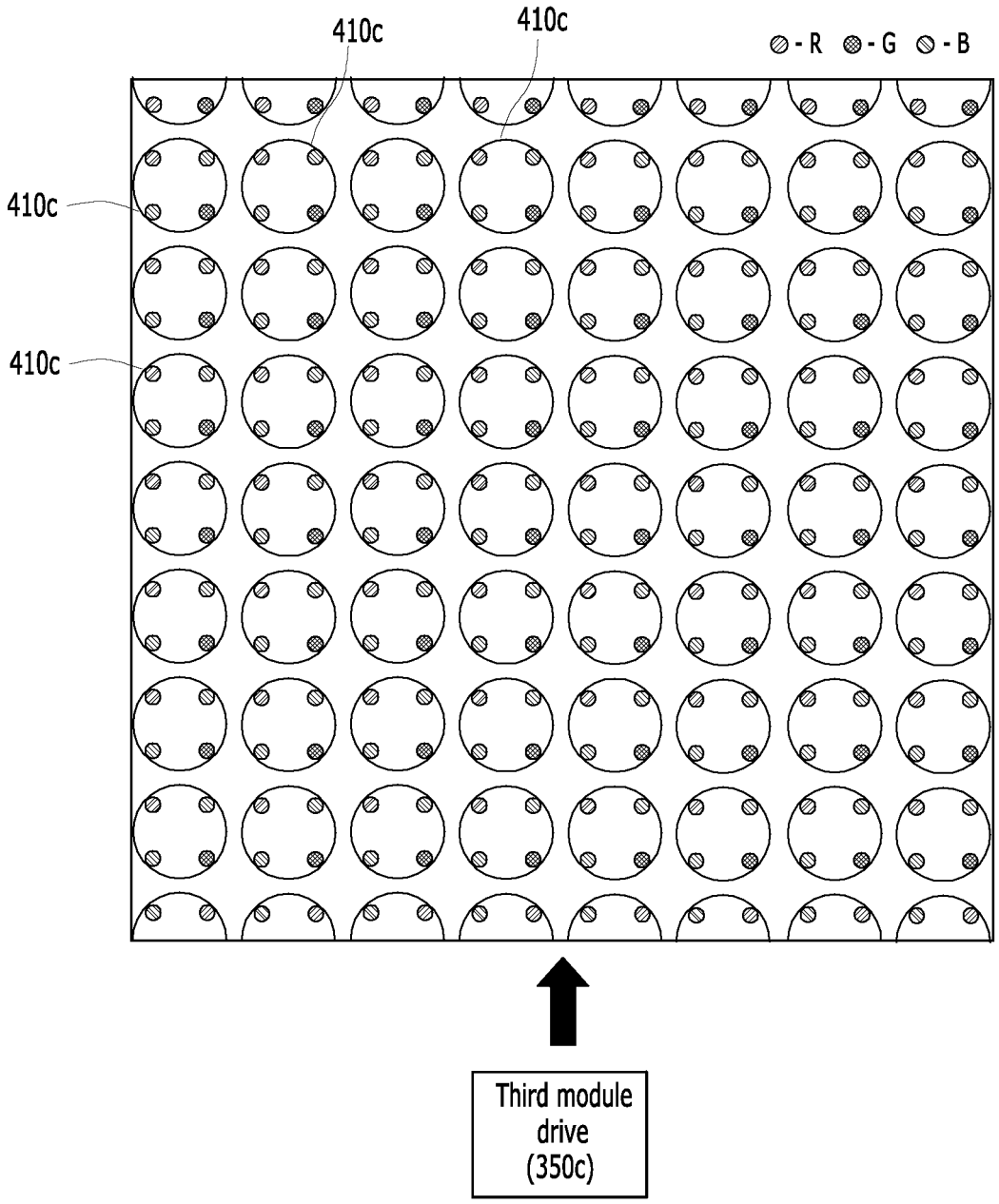
Figure 11:
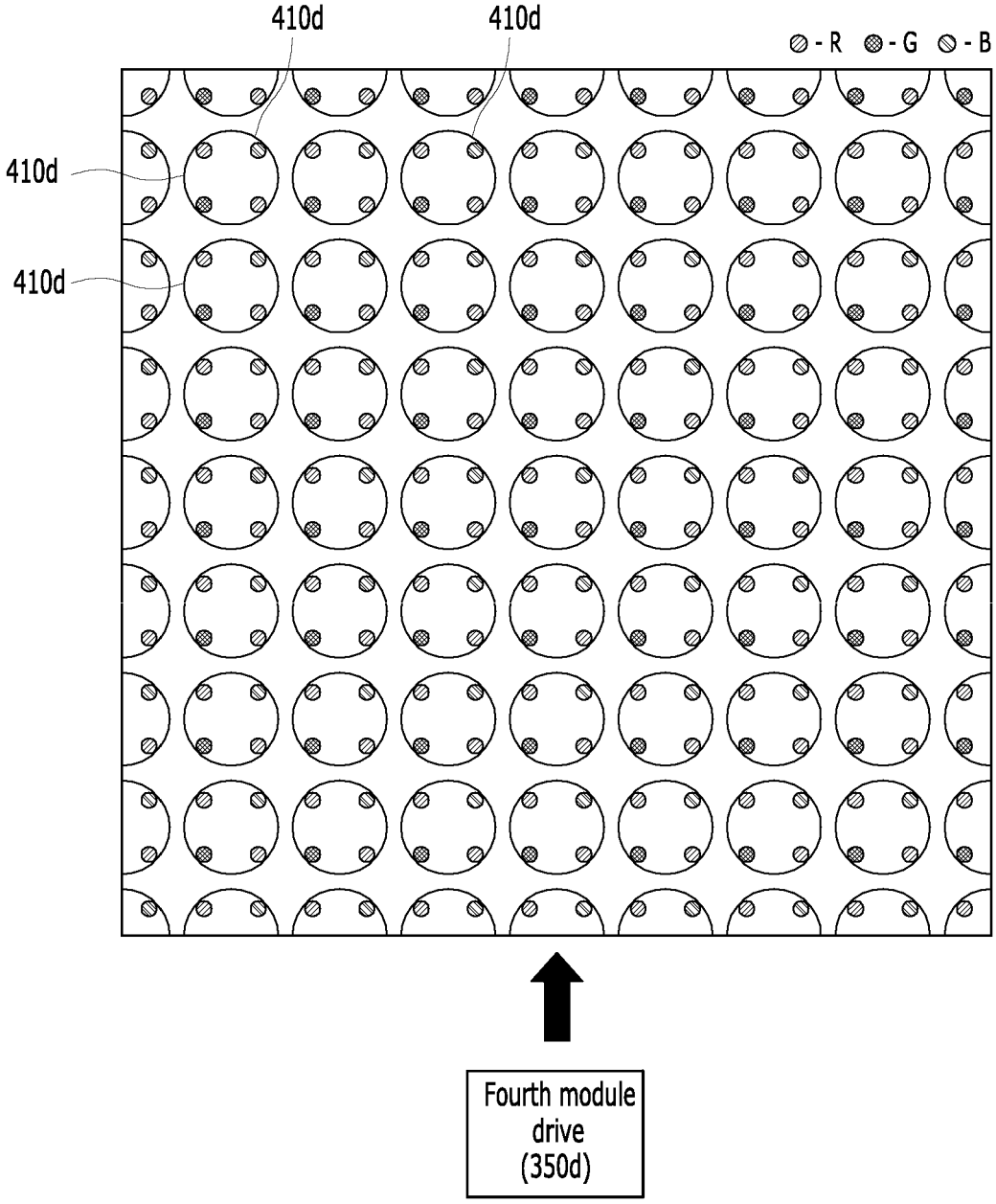

FIG. 7 is a block/showing an inner configuration of an SCU of FIG. 1. The SCU 300 is largely divided into an auto flicker detection unit 310, an integration time setting unit 320, and an image switching unit 340. The auto flicker detection unit 310 generates a flicker-free image by setting a frame frequency of an output image by converting a low-level gray scale into a high-level gray scale through the adjustment of a refresh rate in order to improves the quality of the display image to provide a high quality image through a reduction in flicker noise by a dot output value and a gray scale control value of an LED module of an image output section in response to the switched image data applied thereto by the driving of the main controller 233 of the GSP 230.

The integration time setting unit 320 identifies whether an integration time is an integer multiple of an input period to detect a flick frequency and control the integration time with respect to the flicker-free image generated from the auto flicker detection unit (310), and transmits a relevant image signal to the LED electronic display board module in consideration of the transmitted setting period time so as to be displayed.

In other words, the SCU 300 improves the quality of the display image to provide a high quality image through a reduction in flicker noise by a dot output value and a gray scale control value of an LED module of an image output section in response to the switched image data applied thereto from the GSP 230 so as to enhance the uniformity of White Balance, color, and brightness of an image which is displayed based on a dot output value and a gray scale pixel value of the LED module of the image output section.

The image switching unit 340 performs a switching function of switching a signal designated by the ITS 320 to image data as image display data to allow an image to be displayed on the electronic display board and allows the switched image data to be scanned onto pixel dots in a multi 4-way format so that a high-definition image is displayed on the electronic display board through the module driver 350.

The LED module that is widely used in the conventional LED electronic display board is composed of 16*16 dots in red, green, and blue colors to display an image on one pixel, but when the four-way dual scanning according to the present invention is applied to the LED module, an input image can be outputted as an image of 16*16*4 (1024) dots to provide a high-quality image.

In other words, the LED electronic display board module 400 of the present invention is configured to basically enable the four-way control for each module dot (RGB) pixel to provide a module array multi-scanning enabling the high-definition display.

As shown in FIGS. 8 to 11, each of the unit pixels 410*a*, 410*b*, 410*c* and 410*d* formed by arranging any one of a red LED, a blue LED and a green LED in pairs in a diagonal direction and arranging the remaining two of the red LED, the blue LED and the green LED in two different diagonal directions adjacent to the diagonal direction, respectively, is operated such that an image is displayed on each LED dot array within the module in response to the driving of each of module drivers (350*a*, 350*b*, 350*c*, 350*d*) through image switching units 340*a* and 340*b* of the SCU 300 by scanning RGB of a basic pixel for each module dot (RGB) pixel and using the scanned RGB as a basic unit of RGB.

In other words, the image display of the LED module 400 requires R, G and B to be set as a basic pixel and the LED module 400 is operated in the same manner on corresponding LED dot way arrays, respectively, in response to the driving of the module driver 350 according to the operation of the image switching unit 340 of the SCU 300.

More specifically, for each of the unit pixels 410*a*, 410*b*, 410*c* and 410*d* formed by arranging any one of a red LED, a blue LED and a green LED in pairs in a diagonal direction and arranging the remaining two of the red LED, the blue LED and the green LED in two different diagonal directions adjacent to the diagonal direction, respectively), a unit pixel (410*a:* 1-1) of RGB is driven under the control of a controller of a module driver 350*a* according to the operation of the image switching unit 340*a* of the SCU 300 to allow an image to be displayed on an LED dot 1 way array 400, and a unit pixel (410*b:* 1-2) of RGB is driven under the control of a controller of a module driver 350*b* to allow an image to be displayed on an LED dot 2 way array 400.

In addition, among four adjacent first unit pixels (410*a:* 1-1), one of LEDs adjacent to each other forms a second unit pixel (410*b:* 1-2), one LED adjacent to the first unit pixels 410*a* and the second unit pixel 410*b* forms a third unit pixel (410*c:* 2-1), and one LED adjacent to the second unit pixel 410*b* forms a fourth unit pixel (410*d:* 2-2), so that a screen formed by the first unit pixels 410*a* and a screen formed by the second unit pixels 410*b* are overlapped in the vertical and horizontal directions, and a screen formed by the third unit pixels 410*c* and a screen formed by the fourth unit pixels 410*d* are overlapped in the vertical and horizontal directions.

By virtue of the above-described operation, the first unit pixel (410*a:* 1-1) and the second unit pixel (410*b:* 1-2) are sequentially displayed, and the third unit pixel (410*c:* 2-1) and the fourth unit pixel (410*d:* 2-2) are sequentially displayed so that each of the unit pixels 410*a*, 410*b*, 410*c* and 410*d* is displayed at each resolution to thereby increase the entire resolution by 4-fold in the vertical and horizontal directions.

Figure 13:
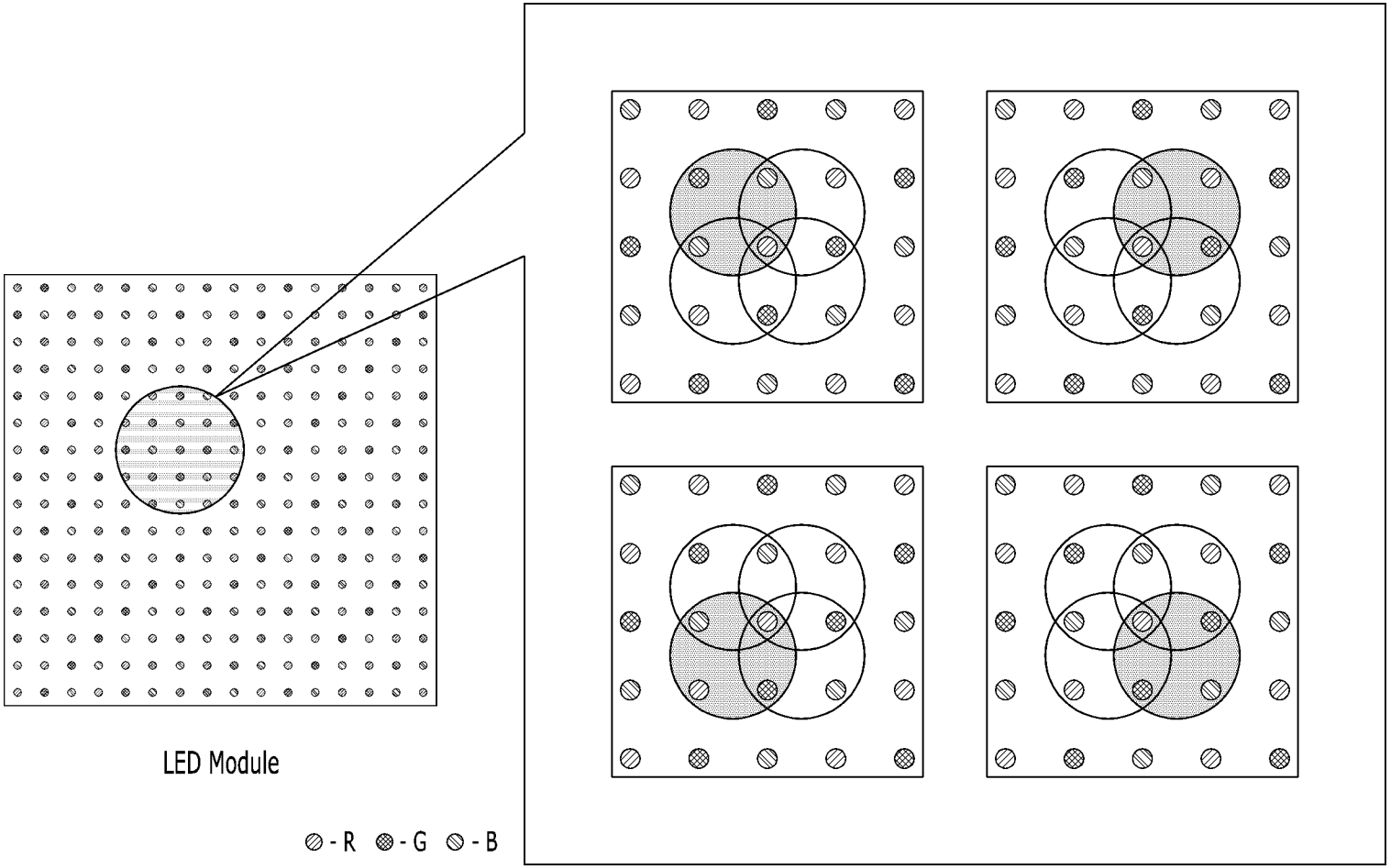
FIG. 13 is a schematic diagram showing a scan state of a four-way dual scanning electronic display board enabling scanning control according to the present invention.
Figure 14:
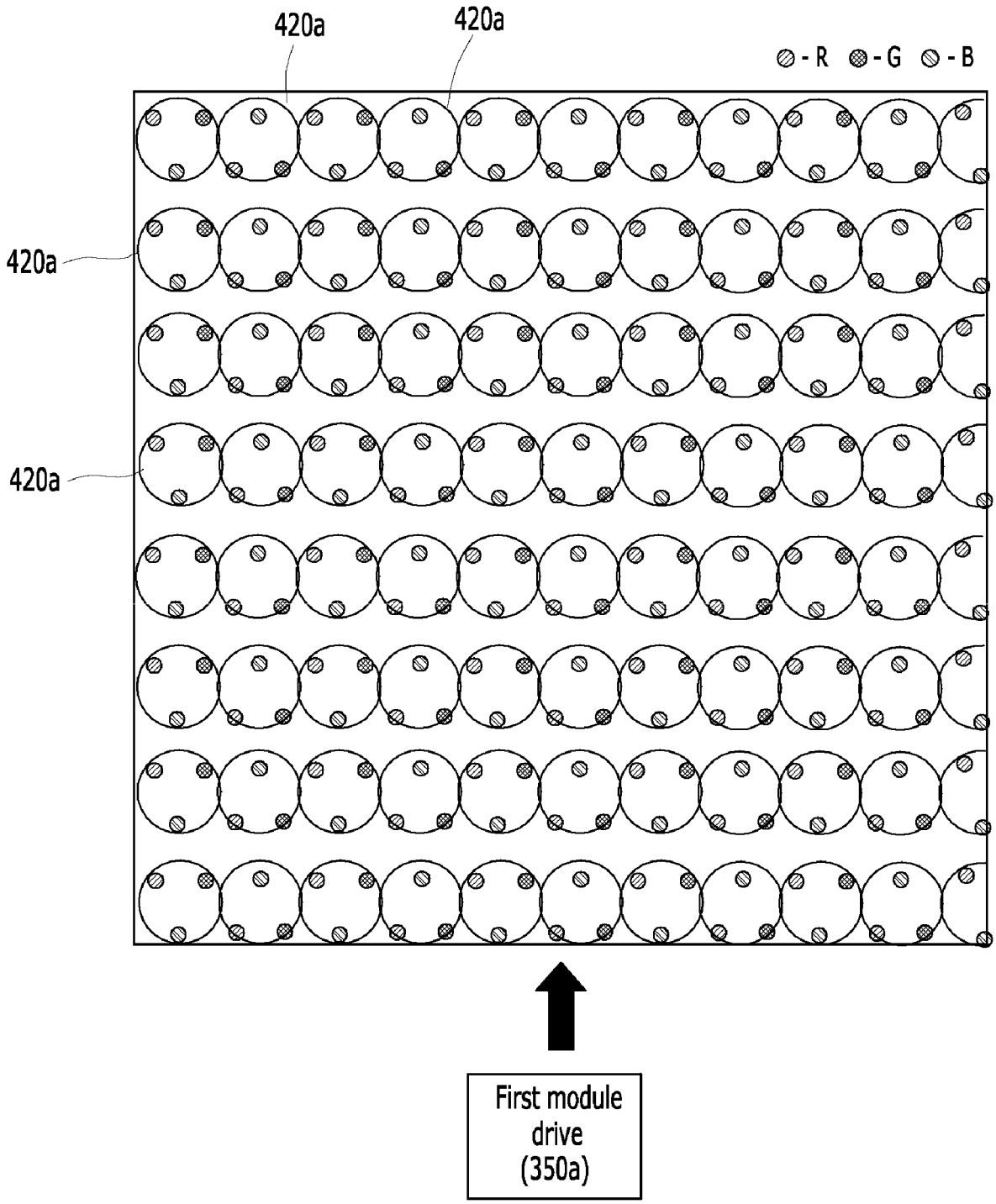
FIGS. 14 to 17 are state diagrams showing the pixel-dependent driving of an LED module of a four-way dual scanning electronic display board enabling scanning control according to another embodiment of the present invention.
Figure 15:
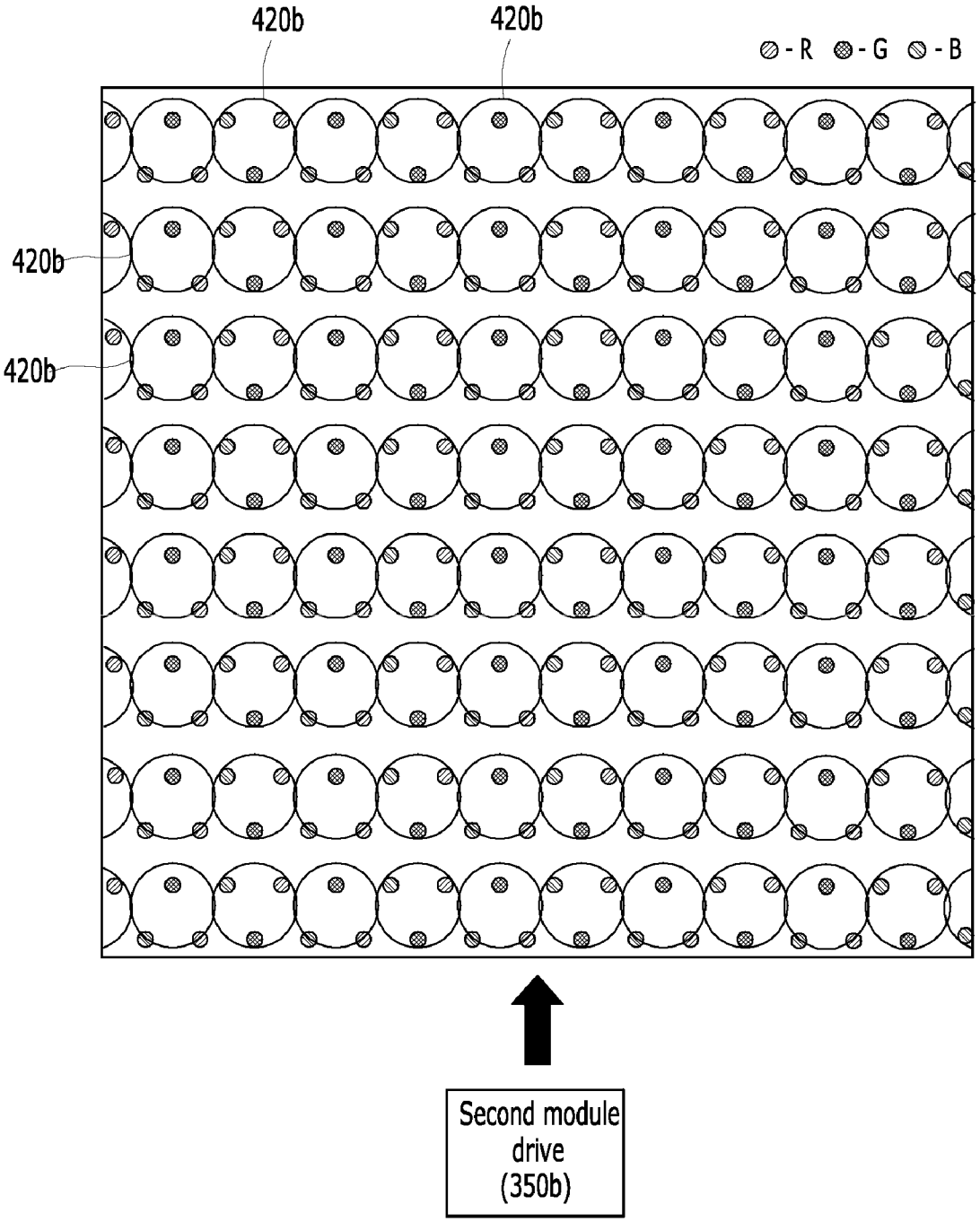
Figure 16:
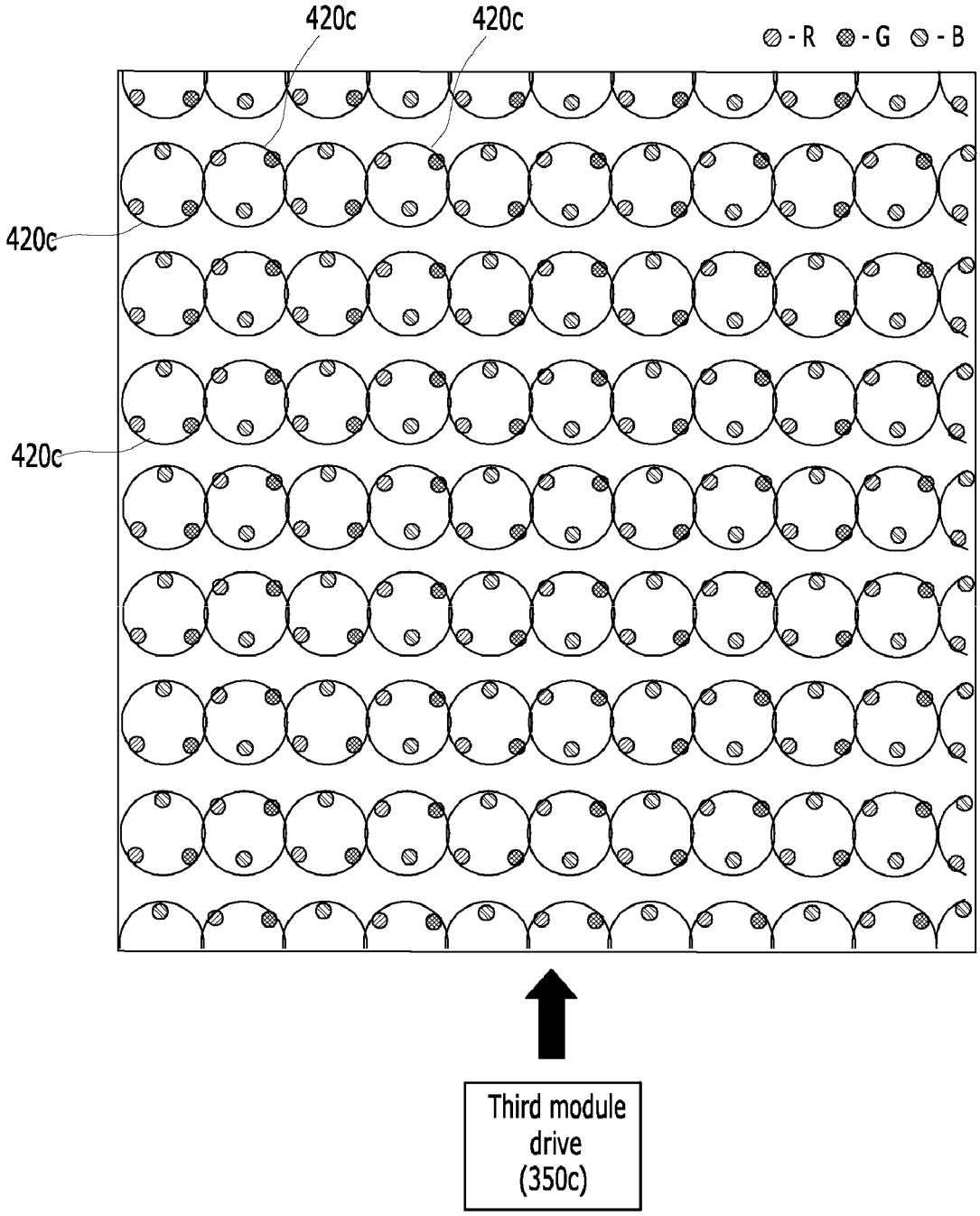
Figure 17:
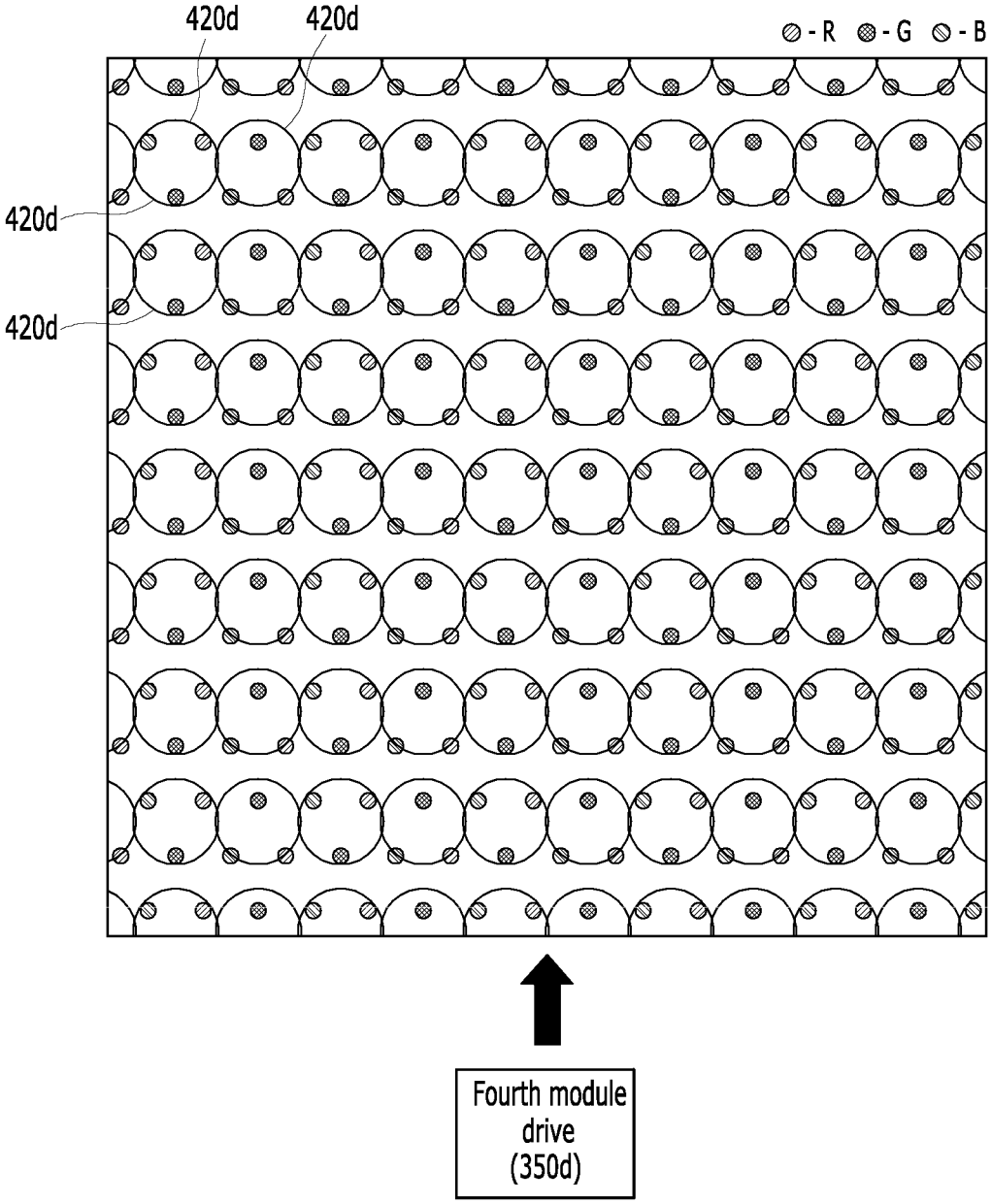

In the same method as that in the above case, for each of the unit pixels 410*a*, 410*b*, 410*c* and 410*d*, a unit pixel 410*c* of RGB is driven under the control of a controller of a module driver 350*b* according to the operation of the image switching unit 340*b* of the SCU 300 to allow an image to be displayed on an LED dot 3 way array 400, and a unit pixel 410*d* of RGB is driven under the control of a controller of a module driver 350*b* to allow an image to be displayed on an LED dot 4 way array 400, so that four adjacent LEDs are provided as one unit pixel 1-1, 1-2, 2-1 or 2-2 in the LED dot type module to form the LED display module as shown in FIGS. 12 and 13.

In addition, in another embodiment of the present invention, each of unit pixels 420*a*, 420*b*, 420*c* and 420*d* of a triangular shape, in which a plurality of RGB LEDs for image representation on the LED module are arranged adjacent to each other to implement a matrix form at a ratio of 1:1:1, is operated such that an image is displayed on each LED dot array within the module in response to the driving of each of module drivers 350*a*, 350*b*, 350*c* and 350*d* according to the operation of image switching units 340*a* and 340*b* of the SCU 300 by scanning RGB of a basic pixel for each module dot (RGB) pixel and using the scanned RGB as a basic unit of RGB.

In other words, the image display of the LED module 400 requires R, G and B to be set as a basic pixel and the LED module 400 is operated in the same manner on corresponding LED dot way arrays, respectively, in response to the driving of the module driver 350 according to the operation of the image switching unit 340 of the SCU 300.

More specifically, as shown FIGS. 14 to 17, for each of unit pixels 420*a*, 420*b*, 420*c* and 420*d* of a triangular shape, in which a plurality of red, green and blue LEDs for image representation are arranged adjacent to each other to implement a matrix form at a ratio of 1:1:1 (=claim 4) by repeatedly arranging red, green and blue LEDs in odd-numbered columns (C1, C3, C5, C7, . . . ) of lines 1, 3, 5, 7, . . . , and repeatedly arranging blue and red and green LEDs in even-numbered columns (C2, C4, C6, C8, . . . ) of lines 2, 4, 6, 8, . . . so as to be positioned diagonally from the red, green and blue LEDs repeatedly arranged in the odd-numbered columns (=EE), a unit pixel (420*a:* 1-1) of RGB is driven under the control of a controller of a module driver 350*a* according to the operation of the image switching unit 340*a* of the SCU 300 to allow an image to be displayed on an LED dot 1 way array 400, and a unit pixel (420*b:* 1-2) of RGB is driven under the control of a controller of a module driver 350*b* to allow an image to be displayed on an LED dot 2 way array 400.

In other words, among three adjacent inverted triangular first unit pixels 420*a:*1-1, one adjacent LED and other adjacent LEDs forms a triangular second unit pixel (420*b:* 1-2), one LED adjacent to the first unit pixel 420*a* and other adjacent LEDs forms a triangular third unit pixel (420*c:*2-1), and one LED adjacent to the second unit pixel 420*b* and other adjacent LEDs forms an inverted triangular fourth unit pixel (420*d:*2-2), so that a screen formed by the first unit pixels 420*a* and a screen formed by the second unit pixels 420*b* are overlappingly displayed in the vertical and horizontal directions, and a screen formed by the third unit pixels 420*c* and a screen formed by the fourth unit pixels 420*d* are overlappingly displayed in the vertical and horizontal directions. Thus, the first unit pixel 420*a* and the second unit pixel 420*b* are sequentially displayed, and the third unit pixel 420*c* and the fourth unit pixel 420*d* are sequentially displayed so that each of the unit pixels 420*a*, 420*b*, 420*c* and 420*d* is displayed at each resolution to thereby increase the entire resolution by 4-fold in the vertical and horizontal directions, and reduce the number of the driving LEDs.

In the same method as that in the above case, for each of the unit pixels 420*a*, 420*b*, 420*c* and 420*d*, a unit pixel 420*c* of RGB is driven under the control of a controller of a module driver 350*b* according to the operation of the image switching unit 340*b* of the SCU 300 to allow an image to be displayed on an LED dot 3 way array 400, and a unit pixel 420*d* of RGB is driven under the control of a controller of a module driver 350*b* to allow an image to be displayed on an LED dot 4 way array 400, so that four adjacent LEDs are provided as one unit pixel 1-1, 1-2, 2-1 or 2-2 in the LED dot type module to form the LED display module.

[The description of reference numerals of the main elements in drawings]

| | |
|---|---|
| 100: image signal source | 200: SCU |
| 210: frame memory | 220: DICT |
| 221: Gamma Controller | 223: Histogram equalizer |
| 230: GSP | 231: Gain Controller |
| 233: Main Controller | 237: Space Corrector |
| 239: Gamma Corrector | |
| 300: SCU | |
| 320: Auto Flicker Detection Unit | 310: Integration Time Setting Unit |
| 330: Bright Control Unit | 340: image switching unit |
| 350: Module Driver | |
| 400: LED electronic display board Module | |

The invention claimed is:

1. A four-way dual scanning electronic display board enabling scanning control, comprising:

an image signal source configured to provide an image signal to an LED electronic display board module;

a main control unit (MCU) configured to switch, by dual scanning, an image in which an image data value with a gamma value determined on a histogram by an image processing DICT unit including a gray scale processor (GSP) has been gray-scaled by the GSP to equalize the image through gamma correction of the image and the histogram of the brightness of the image, so that image data with no noise can be transmitted even under the control of image transmission for high-speed processing;

a server control unit (SCU) configured to control a signal designated by an integration time setting unit (ITS) to be switched to image data as image display data in response to the image data applied thereto after switching, by dual scanning, the image in which the image data value with the gamma value determined on the histogram by the image processing DICT unit of the MCU has been gray-scaled by the GSP and control the switched image data to be scanned onto pixel dots in a multi four-way format to display the image on the LED electronic display board module so as to allow a high-definition image to be displayed on the electronic display board; and the LED electronic display board module configured to form a screen in which unit pixels are formed in a matrix form by arranging any one of a red LED, a blue LED and a green LED in pairs in a diagonal direction and arranging the remaining two of the red LED, the blue LED and the green LED in two different diagonal directions adjacent to the diagonal direction, respectively, in such a manner that the unit pixels are arranged as unit display modules in which a plurality of LEDs are arranged for each of n×m dot (RGB) pixels in the form of a module array, and configured to allow the signal designated by the integration time setting unit (ITS) to be scanned onto pixel dots by the image switching unit in response to the image signal inputted through the image signal source so that image data is displayed thereon in a multi four-way format.

2. The four-way dual scanning electronic display board enabling scanning control according to claim 1, wherein the LED electronic display board module is configured such that each of the unit pixels formed by arranging any one of a red LED, a blue LED and a green LED in pairs in a diagonal direction and arranging the remaining two of the red LED, the blue LED and the green LED in two different diagonal directions adjacent to the diagonal direction, respectively is operated such that an image is displayed on each LED dot array within the module in response to the driving of each of module drivers according to the operation of image switching units of the SCU by scanning RGB of a basic pixel for each module dot (RGB) pixel and using the scanned RGB as a basic unit of RGB.

3. The four-way dual scanning electronic display board enabling scanning control according to claim 2, wherein the LED electronic display board module is configured such that for each of the unit pixels formed by arranging any one of a red LED, a blue LED and a green LED in pairs in a diagonal direction and arranging the remaining two of the red LED, the blue LED and the green LED in two different diagonal directions adjacent to the diagonal direction, respectively, a unit pixel of RGB is driven under the control of a controller of a module driver according to the operation of the image switching unit of the SCU to allow an image to be displayed on an LED dot 1 way array, and a unit pixel of RGB is driven under the control of a controller of a module driver to allow an image to be displayed on an LED dot 2 way array, and wherein among four adjacent first unit pixels, one of LEDs adjacent to each other forms a second unit pixel, one LED adjacent to the first unit pixels and the second unit pixel forms a third unit pixel, and one LED adjacent to the second unit pixel forms a fourth unit pixel, so that a screen formed by the first unit pixels and a screen formed by the second unit pixels are overlappingly displayed in the vertical and horizontal directions, and a screen formed by the third unit pixels and a screen formed by the fourth unit pixels are overlappingly displayed in the vertical and horizontal directions, and thus each of the unit pixels is displayed at each resolution to thereby increase the entire resolution by 4-fold in the vertical and horizontal directions.

4. The four-way dual scanning electronic display board enabling scanning control according to claim 1, wherein the LED electronic display board module is configured such that each of unit pixels of a triangular shape, in which a plurality of RGB LEDs for image representation are arranged adjacent to each other to implement a matrix form at a ratio of 1:1:1, is operated such that an image is displayed on each LED dot array within the module in response to the driving of each of module drivers according to the operation of image switching units of the SCU by scanning RGB of a basic pixel for each module dot (RGB) pixel and using the scanned RGB as a basic unit of RGB.

5. The four-way dual scanning electronic display board enabling scanning control according to claim 4, wherein for each of unit pixels of a triangular shape, in which a plurality of red, green and blue LEDs for image representation are arranged adjacent to each other to implement a matrix form at a ratio of 1:1:1 by repeatedly arranging red, green and blue LEDs in odd-numbered columns (C1, C3, C5, C7, . . . ) of lines 1, 3, 5, 7, . . . , and repeatedly arranging blue and red and green LEDs in even-numbered columns (C2, C4, C6, C8, . . . ) of lines 2, 4, 6, 8, . . . so as to be positioned diagonally from the red, green and blue LEDs repeatedly arranged in the odd-numbered columns, a unit pixel of RGB is driven under the control of a controller of a module driver according to the operation of the image switching unit of the SCU to allow an image to be displayed on an LED dot way array, and wherein among three adjacent inverted triangular first unit pixels, one adjacent LED and other adjacent LEDs forms a triangular second unit pixel, one LED adjacent to the first unit pixel and other adjacent LEDs forms a triangular third unit pixel, and one LED adjacent to the second unit pixel and other adjacent LEDs forms an inverted triangular fourth unit pixel, so that a screen formed by the first unit pixels and a screen formed by the second unit pixels are overlappingly displayed in the vertical and horizontal directions, and a screen formed by the third unit pixels and a screen formed by the fourth unit pixels are overlappingly displayed in the vertical and horizontal directions to allow the first and second unit pixels, and the third and fourth unit pixels to be sequentially displayed, respectively, and thus each of the unit pixels is displayed at each resolution to thereby increase the entire resolution by 4-fold in the vertical and horizontal directions.

* * * * *